United States Patent [19]

Carter

[11] 4,053,732

[45] Oct. 11, 1977

[54] PORTABLE ELECTRIC ROOM AIR HEATER

[76] Inventor: Frank H. Carter, 428 North St., Taft, Calif. 93268

[21] Appl. No.: 629,616

[22] Filed: Nov. 5, 1975

[51] Int. Cl.[2] ..... H05B 1/00; F24H 3/08; F28D 15/00; F24D 13/04

[52] U.S. Cl. ..... 219/365; 126/101; 165/106; 219/341; 219/362; 219/370; 219/530; 237/11

[58] Field of Search ..... 219/365, 342, 341, 530, 219/540, 534, 362, 378, 369, 370; 237/11, 16–18; 165/96, 106, 107, 104; 126/101

[56] References Cited

U.S. PATENT DOCUMENTS

| | | | |
|---|---|---|---|
| 1,043,553 | 11/1912 | Wales | 237/11 |
| 1,052,998 | 2/1913 | Besley | 219/534 X |
| 1,319,733 | 10/1919 | Terry | 219/341 |
| 1,322,761 | 11/1919 | Clark | 219/341 X |
| 1,678,059 | 7/1928 | D'Ardenne | 219/365 |
| 1,838,839 | 12/1931 | Keichline | 237/11 |
| 1,848,716 | 3/1932 | Hart et al. | 219/362 X |
| 1,982,079 | 11/1934 | Spohr | 237/11 X |
| 2,151,140 | 3/1939 | Novak | 219/365 |
| 2,475,077 | 7/1949 | Clancy | 165/96 UX |
| 2,480,809 | 8/1949 | Freyman | 219/341 |
| 2,569,809 | 10/1951 | Flynn | 219/378 |
| 3,681,567 | 8/1972 | Boecher | 237/16 X |

FOREIGN PATENT DOCUMENTS

| | | | |
|---|---|---|---|
| 219,884 | 7/1942 | Switzerland | 219/362 |

*Primary Examiner*—A. Bartis

*Attorney, Agent, or Firm*—Clarence A. O'Brien; Harvey B. Jacobson

[57] ABSTRACT

A room air heater which includes a vertically disposed tubular housing or casing mounted on a mobile supporting structure for ease of movement to a desired location and including a heat exchange coiled tube communicating with a tank having an electric resistance heating element disposed therein. The tank and heating coil are filled with a heat exchange medium in the form of compressed air which circulates through the coil and tank due to the heat imparted to the air by the heating element. A circulating fan is provided in the upper end of the housing for forcing room air downwardly therein in heat exchange relation to the coil with the housing having openings at the bottom thereof for discharge of heated air. Manually adjustable thermostatic controls and a pressure gauge are provided for enabling safe operation of the heater.

2 Claims, 3 Drawing Figures

PORTABLE ELECTRIC ROOM AIR HEATER

BACKGROUND OF THE INVENTION

1. Field of the Invention

The present invention generally relates to room air heaters and more particularly a portable or mobile room air heater embodying a circulating fan and heater assembly employing a closed circulating system in the form of a compressed air tank and heat exchange coil in the form of a tube communicating respectively with the upper and lower ends of the tank with the tank also including a heating element incorporated therein in sealed relation thereto to heat the air and maintain the air under pressure in the tank and in the heat exchange coil communicated therewith.

2. Description of the Prior Art

Many types of portable room air heaters are commercially available including the type having a resistance-type electric heating element associated with a fan which circulates room air past the heating element. Thermostatic control means is provided for the heater to maintain a predetermined temperature. In addition, various types of wall mounted, free standing and portable heaters are provided in which a heat exchange fluid circulates through a coil and reservoir tank in which a heating element is immersed together with a fan for circulating room air over the heating coil. The examples of the development in this field are U.S. Pat. Nos. 1,754,232; 2,041,573; 2,166,509; 2,683,796; 3,277,275; and 3,567,905.

SUMMARY OF THE INVENTION

An object of the present invention is to provide a room air heater which includes a sealed circulating hot air system in which a heat exchange coil and an air pressure tank are communicated and filled with compressed air together with a heating element disposed in the compressed air tank for heating the compressed air to a predetermined temperature and causing circulation thereof so that a fan circulating room air over the heat exchange coil will heat the room air to a desired temperature as determined by a thermostatic control device.

Another object of the invention is to provide a room air heater in which the heat exchange coil, compressed air tank and related controls are mounted on a portable base and include a tubular housing encompassing the components of the heater and including an air inlet adjacent the upper end and an air outlet adjacent the bottom end for circulation of air downwardly over the heat exchange coil by a circulating fan located at the upper end of the housing.

A further object of the invention is to provide a room air heater in accordance with the preceding objects in which the supporting structure for the housing is in the form of a wheeled platform enabling the room air heater to be easily moved to a desired location with the housing including openings at the bottom thereof to enable discharge of heated room air and also providing access to the lower end of the housing for facilitating the positioning of a water pan in the lower end of the housing so that downwardly forced room air will impinge upon the surface of the water for maintaining desired temperature conditions within the room and to clean the air discharged from the room air heater.

Still another important object of the present invention is to provide a room air heater in accordance with the preceding objects which is relatively simple in construction, efficient in operation, easily moved to a desired location, provided with appropriate controls and relatively inexpensive to manufacture and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
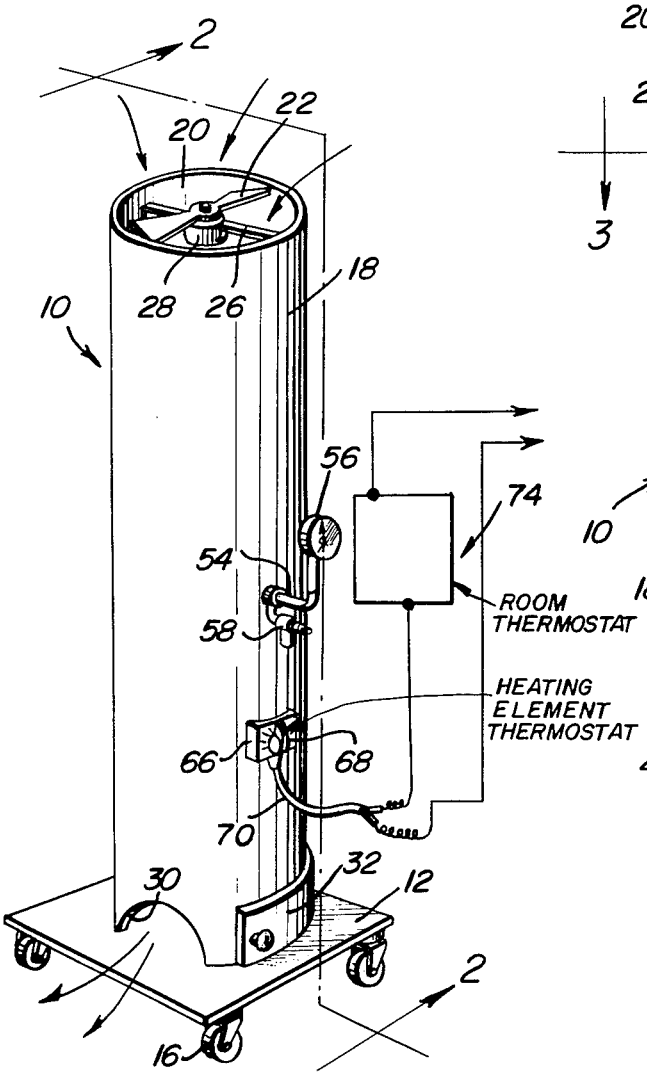
FIG. 1 is a perspective view of the room air heater of the present invention illustrating schematically a thermostatic control for the heater.

The room air heater of the present invention is generally designated by reference numeral 10 and may be oriented in any suitable desired enclosed space such as a room in which it is desired to maintain the ambient air at a predetermined temperature and to maintain the air clean and within certain humidity levels.

The heater 10 includes a supporting platform 12 which may be in the form of a square or rectangular plate or baffle of any desired size, shape and configuration and which may be provided with any desired decorative appearance. The base 12 is supported for movement along the floor surface 14 of a room by a plurality of supporting wheels 16 which may be conveniently in the form of conventional caster wheels so that the room air heater may be rolled to a desired location.

Extending upwardly from and rigid with the supporting base 12 is an elongated tubular housing or casing 18 which is preferably cylindrical in construction although it may be of other desired shapes and configurations with the housing 18 being preferably constructed of sheet material such as sheet metal or the like and the external surface thereof may be provided with any ornamentation or decorative characteristics as desired. The upper end of the housing 18 is open as indicated by numeral 20 and provides an air inlet to the interior of the housing. Adjacent the upper end of the housing 18 is an axial flow fan 22 driven and supported by a suitable motor 24 which is centrally supported in the upper end portion of the housing 18 by a supporting bracket assembly 26 in the form of a plurality of radial arms and a central sleeve 28 encircling the motor 24 for mounting the same centrally in the housing 18. An electrical conductor 72 is provided in a conventional manner so that it will drive the fan 22 when desired. Also, a screen, grill or the like may be provided on the open upper end of the housing 18 if desired in order to prevent accidental contact with the fan blade 22.

Figure 2:
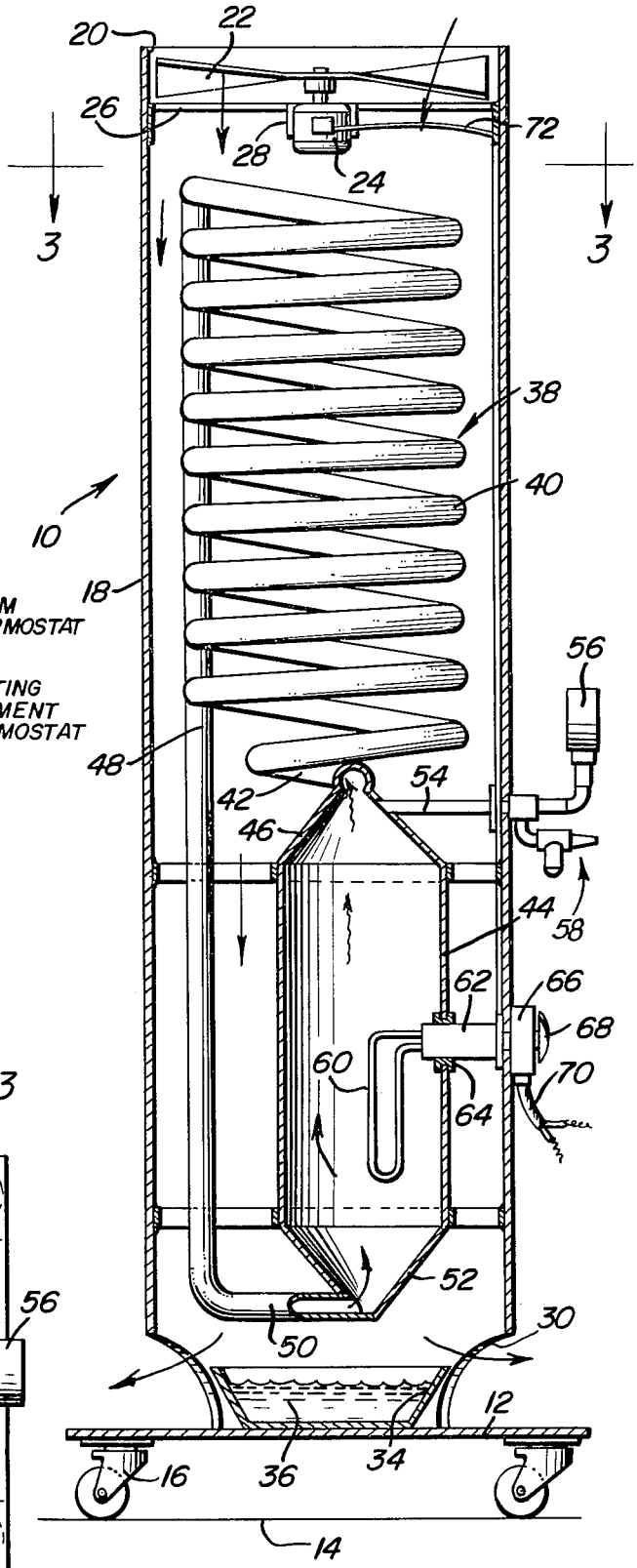
FIG. 2 is a vertical sectional view, on an enlarged scale, taken substantially upon a plane passing along section line 2—2 of FIG. 1 illustrating the specific structural relationships of the components of the heater.
Figure 3:
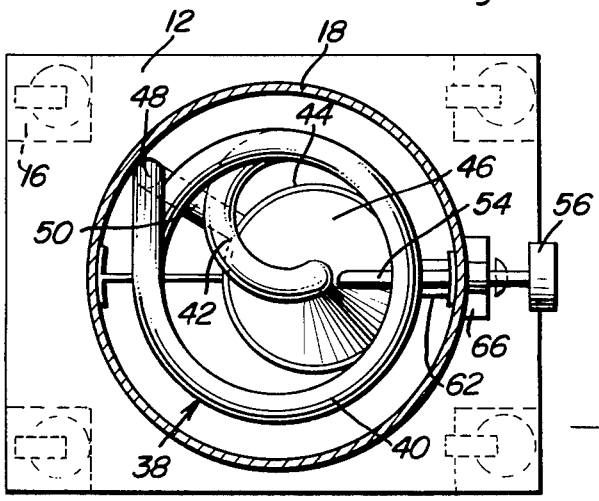
FIG. 3 is a transverse, sectional view taken substantially upon a plane passing along section line 3—3 of FIG. 2 illustrating further structural arrangements of the heater.

The lower end of the housing 18 is provided with a pair of enlarged openings 30 in the form of arcuate notches or cut-outs in the peripheral wall defining the housing 18 thus providing circumferentially spaced hot air outlet openings for discharge of heated air into the room as indicated by the arrows in FIGS. 1 and 2. The location of the openings 30 may be varied for providing directional control for discharge of the heated air and, if desired, dampers or closures may be provided for any or all of the openings 30 for further control of the air being discharged.

Also, the lower end of the housing 18 is provided with a pivotal access door 32 at one side thereof which defines an opening of sufficient dimensions to enable insertion of a shallow pan or container 34 which must hold at least 2 gallons of water 36 with an antiseptic, such as "Listerine", added thereto so that when the water evaporates, the antiseptic evaporates thereby killing some of the germs in the room. This also maintains a desired humidity level and also, the heated air impinging upon the surface of the water 36 will be somewhat cleaned before it is discharged back into the room thereby maintaining the room air at a desired level of humidity and cleanliness.

Disposed within the tubular housing 18 is a heat exchange coil 38 in the form of a helically coiled tube 40 in which the convolutions are spaced from each other and also are spaced concentrically with respect to the housing 18 although the convolutions are disposed so that the diameter of the circle defined by the inner surface of the convolutions is at least one-half of the diameter of the housing 18 and the outside diameter of the convolutions of the coiled tube 40 is substantially more than one-half the diameter of the casing or housing 18. The heat exchange coil occupies a substantial portion of the upper portion of the housing 18 as illustrated in FIG. 2 and terminates slightly below the fan 22. The lowest convolution of the coiled tube 40 extends inwardly at 42 and is communicated with the upper end of a compressed air tank 44 which has a conical upper end 46 with the apex sealed to and communicated with the end of the coiled tube 40. The uppermost convolution of the coiled tube 40 is provided with a vertical tube 48 communicated therewith and oriented outside of the coiled tube 40 with the tube 48 extending downwardly along side of the coil and tank 44 as illustrated in FIG. 2 with the lower end of the tube 48 terminating in an inwardly extending tube 50 communicated with and sealed in relation to the lower conical end 52 of the compressed air tank 44. Thus, the heat exchange coil 38 and the compressed air tank 44 form a closed system for circulation of heated compressed air. A tube 54 is communicated with the tank 44, preferably at the upper end thereof as illustrated in FIG. 2, with the tube 54 extending out through the housing 18 and being provided with a pressure gauge 56 on the outer end thereof. Also, a fitting 58 is provided on the tube 54 externally of the housing 18 in order to fill the tank 44 and coiled tube 40 with compressed air at a predetermined pressure such as 15 psi. A safety valve may be incorporated into the fitting 58 set at a predetermined pressure so that in the event the pressure in the tank and tube exceeds a predetermined safe pressure, the compressed air will be discharged to prevent any possibility of the tank or coiled tube being ruptured.

Also mounted in the tank 44 is a heating element 60 of the resistance-type in the form of a generally U-shaped rod supported by an adaptor 62 extending through the wall of the tank 44 and being sealed thereto as at 64 and provided with a housing 66 for a switch including a manually adjustable thermostatic control 68. An electric conductor 70 is connected to the housing 66 for supplying electrical energy to the heater 60 and to the fan 24 through the electric conductor 72. The thermostatic switch 68 controls the heating element 60 to maintain it at a predetermined temperature for maintaining the air in the tank and tube at a predetermined temperature level within certain high and low limits. The electrical conductor 70 is associated with a thermostatic controlled device generally designated by numeral 74 which is responsive to room air temperature for turning the room air heater on or off. Thus, the room air thermostat 74 will supply electrical energy to the thermostatic switch 68 which maintains safe operating temperature levels for the heating element and also supplies electrical energy to the fan 22 so that it will come on automatically when the room air thermostat demands heat or the fan can be arranged so that it only is operative when the heating element is operative, although it is usually desirable to run the fan 22 during the heat-up and cool-down cycle of the room air heater.

In operation, the air is circulated downwardly through the casing 18 and passes over and around the coiled tube 40 and is discharged out through the openings 30 after it has been cleaned or purified by impingement on the water 36 having any suitable additive therein. The movement of the air between the coil 38 and the housing 18 will maintain the housing 18 at a comfortable temperature level so that contact with the housing 18 by the hands will not cause accidental burning or injury thereby enabling the heater to be moved to a desired position even when the heater is in operative condition.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A room air heater comprising a vertically disposed, elongated tubular housing having air inlet means adjacent the upper end thereof and air outlet means adjacent the lower end thereof, fan means in said housing for circulating room air downwardly from the air inlet means adjacent the ceiling to the air outlet means, a heat exchange coil disposed within said housing, a heat exchange air containing tank disposed within said housing and having its upper and lower ends communicated respectively with the remote ends of the heat exchange coil for circulation of heat exchange air from the tank, through the coil and back to the tank, said coil and tank being filled with compressed air serving as the heat exchange air with the compressed air being at approximately 15 psi, a heater element disposed in the tank for heating the heat exchange air therein for causing circulation of such air through the coil and tank whereby room air passing over the coil and tank will be heated, said fan means being located adjacent the upper end of the housing, said tank being vertically elongated and disposed in the lower portion of the housing in peripherally spaced relation thereto and above the air outlet means, said heat exchange coil being disposed below the room air inlet means and above the tank with the heat exchange coil being in the form of a helically coiled tube peripherally spaced from the interior of the housing so that air passing downwardly between the heat exchange coil and housing and between the tank and housing will maintain the housing in a substantially cool condition thereby enabling hand contact with the housing without injury due to burning, said heating element being an elongated electric resistance-type heating rod disposed longitudinally in the tank for heating the compressed air during vertical movement thereof in the tank, thermostatic control means for controlling operation of the heating element and fan means, and a supporting base for the housing with the housing being rigidly secured thereto, said supporting base extending peripherally of the housing and being provided with supporting wheel means thereon to enable the heater to be easily moved from one location to another thereby eliminating installation cost, said air outlet means including circumferentially spaced notched openings formed in the lower end of the housing at its juncture with the base, said housing including a lateral opening provided with a closure door adjacent the lower end thereof, a pan of less height than the air outlet means, said pan having a quantity of water and antiseptic therein and disposed interiorly of the housing and resting on the supporting base in the flow path of air exiting from the air outlet openings for impinging the air onto the surface of the water for vaporizing and entraining some of the water and antiseptic therein.

2. The structure as defined in claim 1 wherein said housing is of cylindrical configuration with the air inlet means including an open top on the housing disposed in adjacent relation to the ceiling for removing the hottest air in the room next to the ceiling with the fan means and moving it through the housing, over the coil, tank and pan and discharging it out through the air outlet means adjacent the floor of the room, said fan means including a fan blade disposed adjacent the open end of the housing and rotatable about an axis disposed centrally of the housing, said base being polygonal and extending substantially beyond the housing, said wheel means being disposed adjacent the periphery of the base to stabilize the heater.

* * * * *